US005999145A

United States Patent [19]

Niekamp

[11] Patent Number: 5,999,145

[45] Date of Patent: Dec. 7, 1999

[54] ANTENNA SYSTEM

[75] Inventor: Rex Leonard Niekamp, Quincy, Ill.

[73] Assignee: Harris Corporation, Melbourne, Fla.

[21] Appl. No.: 09/105,829

[22] Filed: Jun. 26, 1998

[51] Int. Cl.[6] ..... H01Q 1/12

[52] U.S. Cl. ..... 343/890; 343/800; 343/892

[58] Field of Search ..... 343/890, 878, 343/892, 800, 795, 767

[56] References Cited

U.S. PATENT DOCUMENTS

| | | | |
|---|---|---|---|
| 2,480,154 | 8/1949 | Masters | 250/33 |
| 5,418,545 | 5/1995 | Pantsios et al. | 343/795 |
| 5,497,166 | 3/1996 | Mahnad | 343/795 |
| 5,533,304 | 7/1996 | Noble | 52/40 |
| 5,774,193 | 6/1998 | Vaughan | 348/723 |
| 5,787,673 | 8/1998 | Noble | 52/726.1 |
| 5,861,858 | 1/1999 | Niekamp | 343/800 |
| 5,880,701 | 3/1999 | Bhame et al. | 343/890 |

*Primary Examiner*—Hoanganh Le
*Assistant Examiner*—Shih-Chao Chen
*Attorney, Agent, or Firm*—Tarolli, Sundheim, Covell, Tummino & Szabo

[57] ABSTRACT

An antenna system is presented herein for radiating RF energy. This system includes a vertical mast having N vertically oriented faces which surround a vertically extending mast and wherein N is equal to at least 3. A plurality of vertically spaced antenna bays is provided with each bay having an array of N antennas carried by the mast. Each antenna includes radiating means located substantially in a plane parallel to one of the N faces. Each face is oriented at a given angle $$\frac{360^\circ}{N}$$

from an adjacent face. The mast has N corners, each corner being located intermediate a pair of faces. N fins are provided with each fin being associated with one of the corners and extending radially outward of the axis beyond the associated corner.

26 Claims, 7 Drawing Sheets

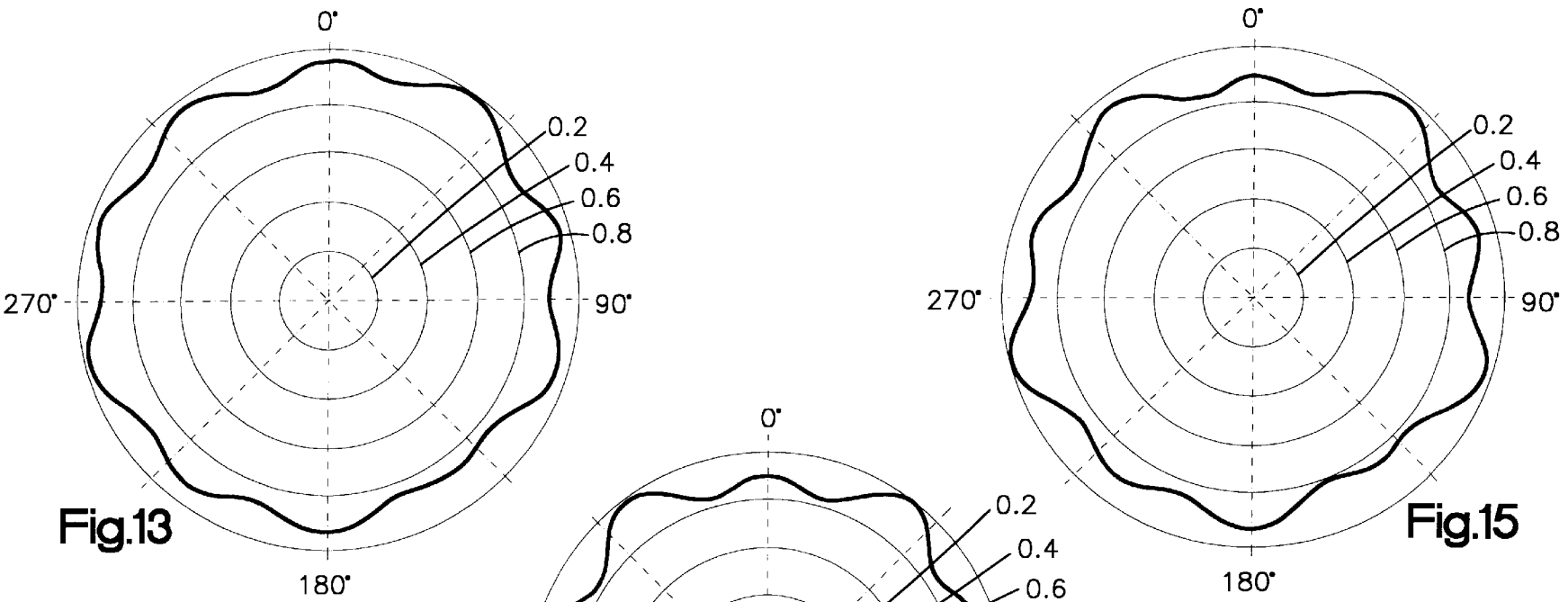
Fig.13
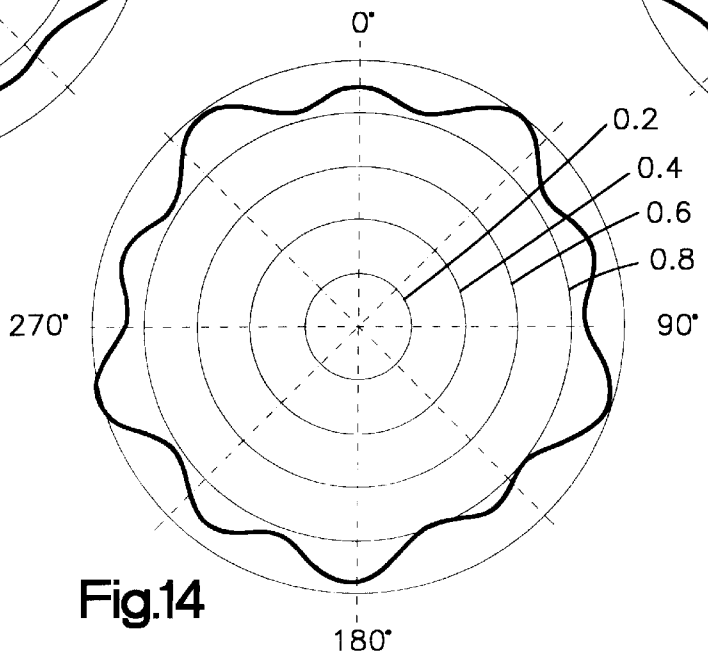
Fig.14
Fig.15

ANTENNA SYSTEM

FIELD OF THE INVENTION

This invention relates to the art of antennas and, more particularly, to novel structure resulting in improved radiation patterns.

At present, the TV industry is introducing high definition television (HDTV) having a digital format. As a result, there is a need to accommodate installation of additional broadcasting antennas. A UHF antenna, for example, may be located on top of a tower that is 1,000 feet tall and the UHF antenna itself may be on the order of 50 feet in length. In order to accommodate additional TV stations there is a need to increase the capacity of such towers by providing multichannel antennas. Consequently, it is desirable to vertically stack one antenna on top of another. Stacking antennas requires mounting structures that are strong enough and stiff enough to support additional antennas on top of each other in a vertical orientation.

In addition to providing increased structural strength, it is also desirable that such antennas produce good omnidirectional coverage (an Azimuth pattern with a perfect circle is desired). Such omnidirectional coverage is paramount to a TV station maximizing its income.

It is known in the art to utilize UHF panel antennas for transmitting TV signals. Such panel antennas are described, for example, in Pantsios, et al. U.S. Pat. No. 5,418,545. Typically, such panel antennas are mounted around a supporting mast having several faces to obtain good Azimuth pattern circularity. Thus, for example, a plurality of vertically spaced bays of antennas may be mounted on such a mast. Each bay may include four (4) or more panel antennas. Each panel antenna is placed on one face of a square mast, each face being about 2 feet in width. Since it is desired to stack several antenna systems each having several bays it is desirable to increase the structural strength of such an antenna construction. Increasing the mast size from 2 feet for each face to 3 feet for each face increases the structural strength but decreases the pattern circularity of the radiation pattern.

It has been found that pattern circularity may be improved by increasing the number of faces and, hence, the number of panel antennas in each bay. Thus, a mast having five faces (a pentagonal mast) will carry five panel antennas for each bay. If each face is 20 inches wide, the pattern circularity improves but the mast is somewhat limited in structural strength. If the width of each face is increased to, for example, 36 inches then the structural strength is increased but the pattern circularity is decreased.

It has been determined that adding radially extending fins at the corners of such a multi-faced mast increases the structural strength (because more of the metal has been positioned outwardly from the central axis of the structure) while at the same time the pattern circularity is dramatically improved.

SUMMARY OF THE INVENTION

In accordance with the present invention, an antenna system is presented for use in radiating RF energy. The system includes a vertical mast having N vertically oriented faces surrounding a vertically extending axis, wherein N is at least equal to 3. A plurality of vertically spaced antenna bays are provided with each bay having an array of N antennas carried by the mast. Each antenna includes radiating means located substantially in a plane parallel to one of the N faces. Each face is oriented at a given angle of $$\frac{360^\circ}{N}$$

from an adjacent face. The mast has N corners, with each corner being located intermediate a pair of adjacent faces. N fins are provided with each fin associated with one of the corners. Each fin extends radially outward of the axis beyond the associated corner.

BRIEF DESCRIPTION OF THE DRAWINGS

The foregoing and other objects and advantages of the present invention will become more readily apparent from the following as taken in conjunction with the accompanying drawings wherein:

FIG. 13 illustrates a horizontal polarized Azimuthal radiation pattern for a structure as shown in FIG. 7;

FIG. 14 illustrates a horizontal polarized Azimuthal radiation pattern for a structure as shown in FIG. 7; and FIG. 15 illustrates a horizontal polarized Azimuthal radiation pattern for a structure as shown in FIG. 7;

DESCRIPTION OF THE PREFERRED EMBODIMENT

Figure 1:
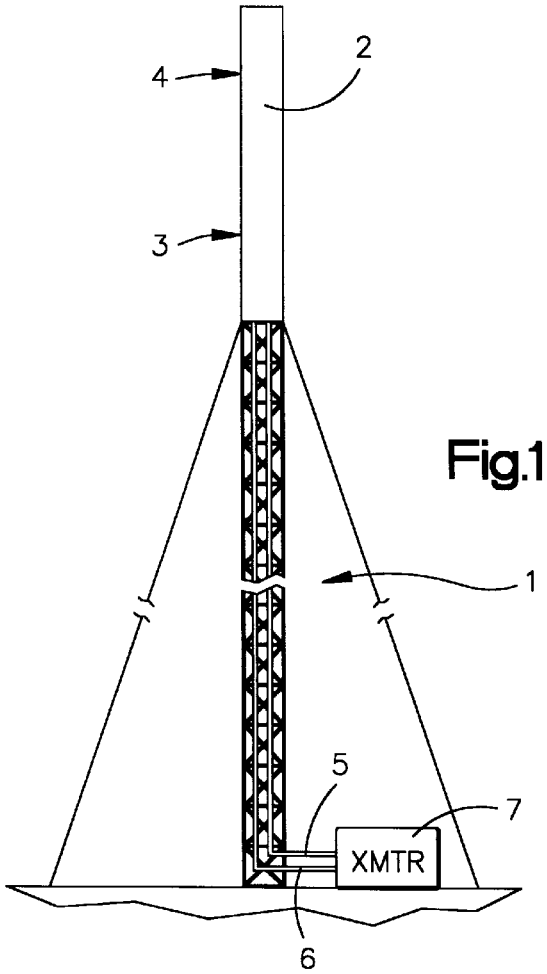
FIG. 1 is an elevational view of a UHF antenna mounted on top of a tower and which is useful in describing the invention herein.

Reference is now made to FIG. 1 which illustrates a UHF antenna system which may be employed for transmitting signals for two TV stations simultaneously. This system includes a tower 1 which, for example, may extend 1,000 feet. Mounted on top of tower 1 there is provided an antenna system including a vertically extending cylindrical radome 2 which encircles two groups 3 and 4 of antennas. Each group may be made up of a plurality of vertically stacked antenna bays. The antenna system including groups 3 and 4 may extend, for example, approximately 100 feet above tower 1 and each group may, for example, include 12 bays.

The two groups of antennas 3 and 4 are fed with RF energy by means of RF feeds 5 and 6, respectively, which extend from a suitable transmitter 7 to the tower. These feeds 5 and 6 may take the form of coaxial cables or the like. The feeds extend upward within the tower 1 and are secured thereto by suitable means known in the art.

Figure 2:
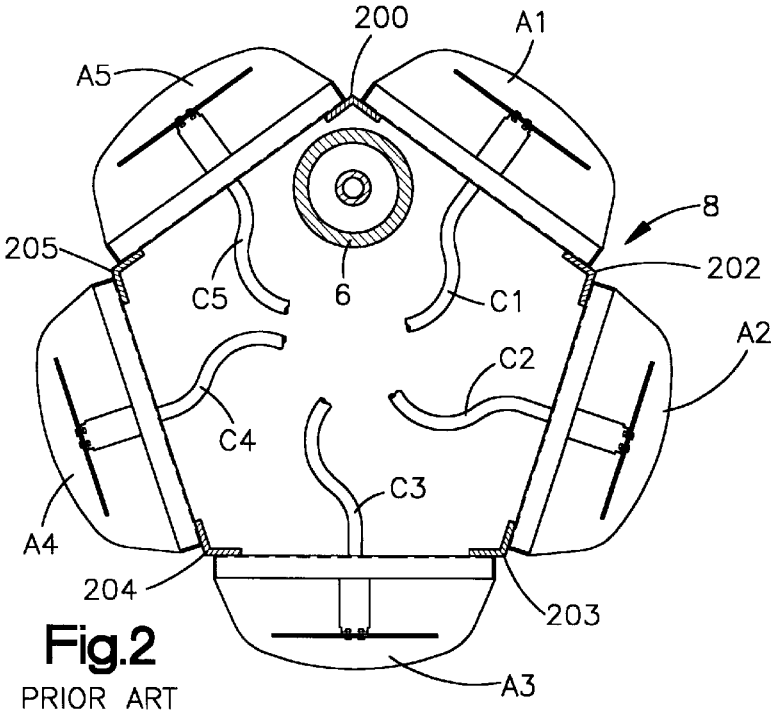
Fig.2 PRIOR ART
FIG. 2 is a cross-sectional view which illustrates a prior art mast.

Reference is now made to FIG. 2 which illustrates a prior art system including an antenna mast 8 which is pentagonal in cross-section having five faces so that each bay carries five panel antennas A1, A2, A3, A4 and A5. Each of these panel antennas illustrated in FIG. 2 has an associated panel radome.

Each of the panel antennas such as antenna A1 is connected to an RF source such as the transmitter 7, by way of an appropriate feed such as one of the coaxial cables C1, C2, C3, C4 and C5. These cables may extend from a power splitter which is fed by feed 5 which extends upward through the antenna system from the transmitter 7. To facilitate a better understanding of the panel antennas and the manner in which they are excited, reference is now made to the discussion that follows relative to FIGS. 3, 4 and 5. These figures have been incorporated from the aforesaid U.S. Pat. No. 5,418,545.

Figure 3:
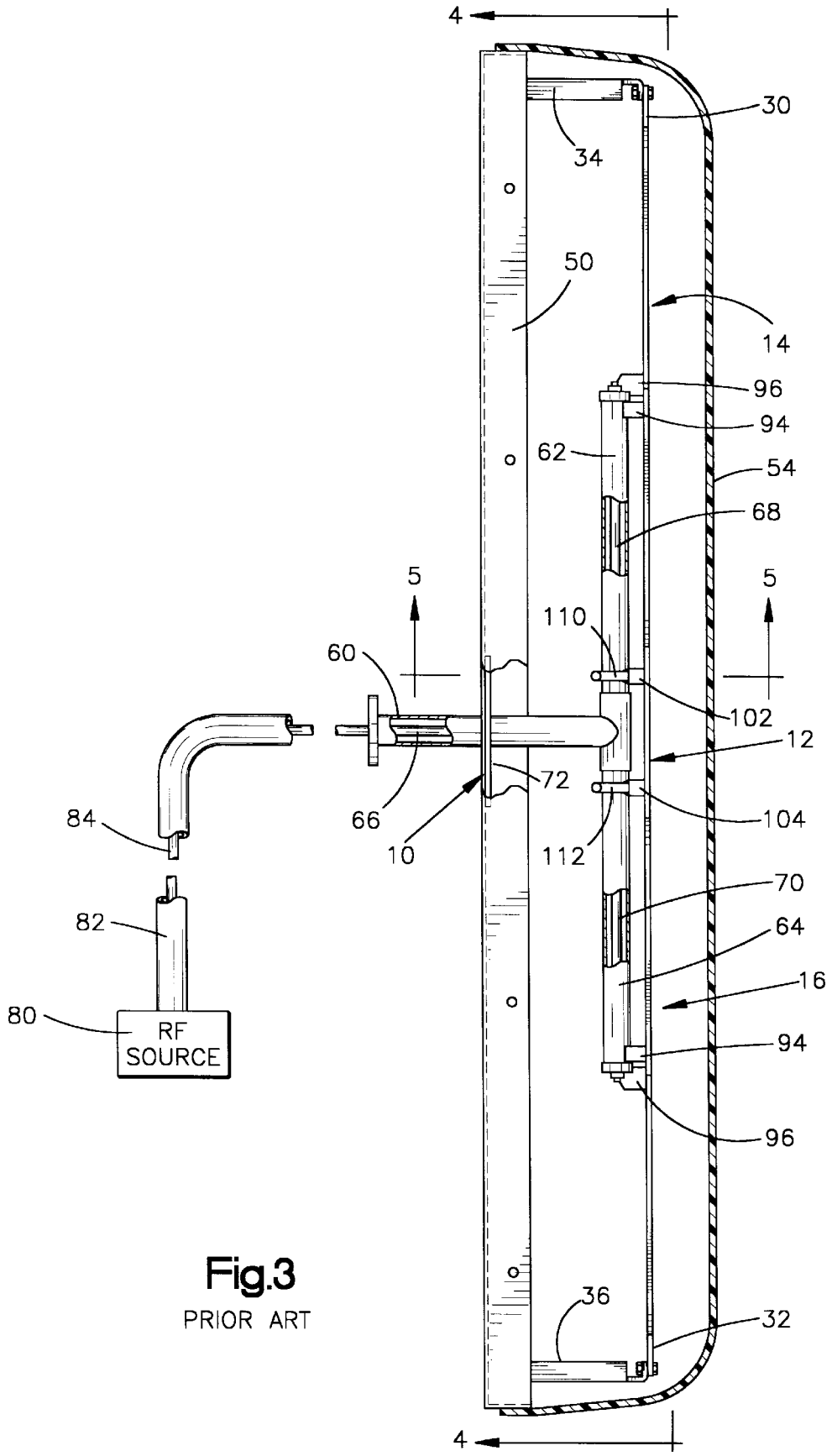
Fig.3 PRIOR ART
FIG. 3 is a side elevational view with parts broken away illustrating a prior art panel antenna which may be employed in practicing the present invention.
Figure 4:
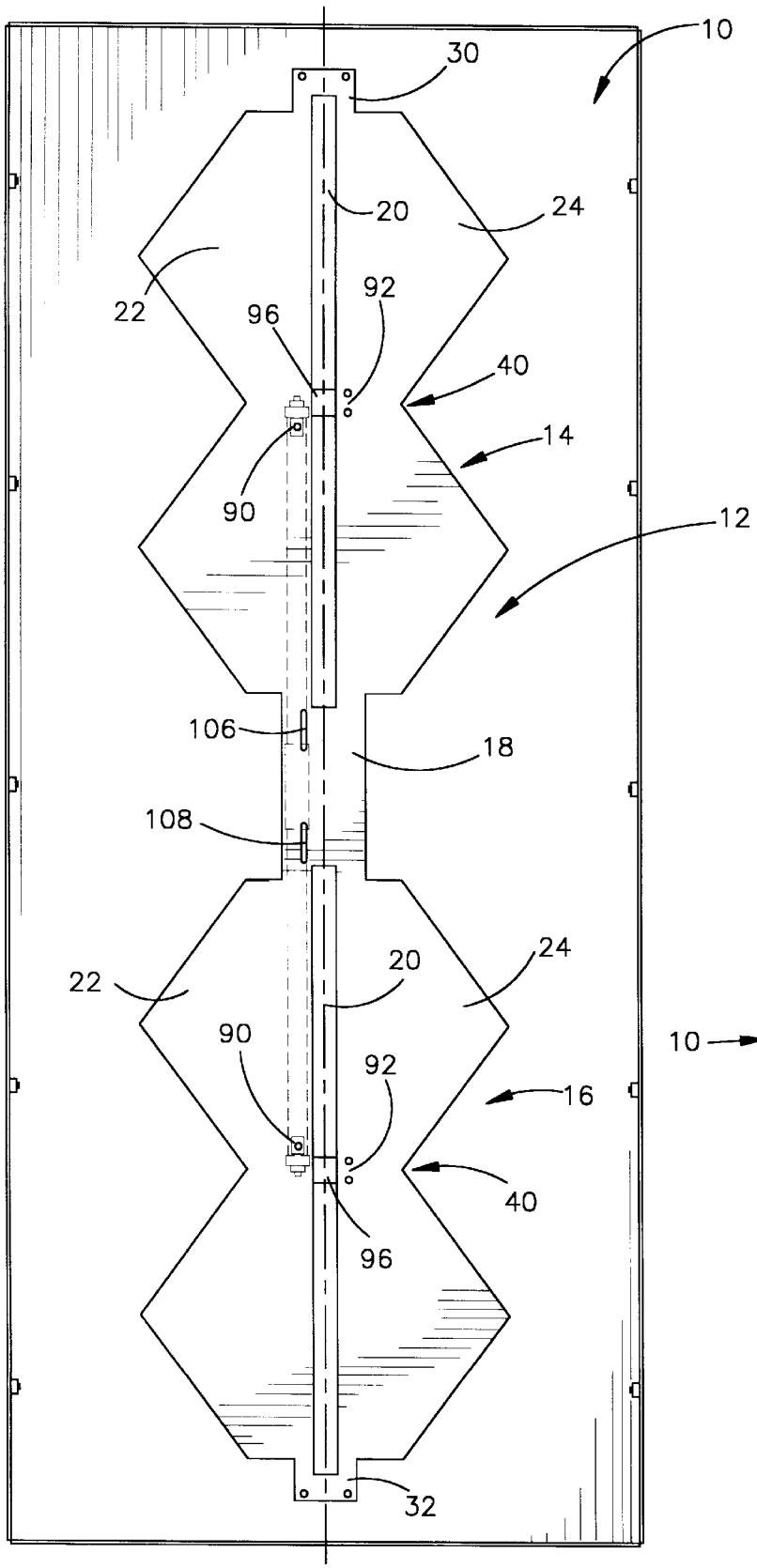
Fig.4 PRIOR ART
FIG. 4 is a view taken generally along line 4—4 looking in the direction of the arrows in FIG. 3 but with the radome removed.
Figure 5:
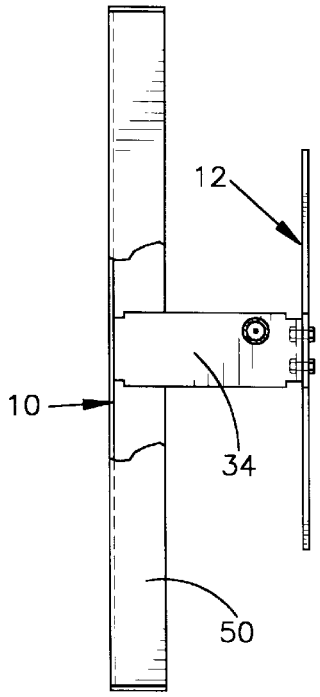
Fig.5 PRIOR ART
FIG. 5 is a view taken along line 5—5 looking in the direction of the arrows in FIG. 3 with the radome removed.

Reference is now made to FIGS. 3, 4 and 5 wherein there is illustrated a panel antenna of the type employed in FIG. 2 for radiating horizontal polarized energy. This includes an elongated rectangular-shaped flat reflector or backscreen 10 constructed of a solid sheet of metal and which is shown in the drawings as being oriented in a vertical direction. A flat, elongated panel antenna 12 of solid sheet metal is vertically oriented and spaced in front of and parallel to the backscreen 10. The panel antenna 12 includes a pair of vertically-interconnected antennas 14 and 16, which are interconnected by means of an intermediate member 18.

Each of the antennas 14 and 16 includes an elongated vertically oriented slot 20 which divides the antenna into a pair of horizontally extending variable length wings including a left wing 22 and a right wing 24. Each of these wings may be considered as a horizontally extending variable length dipole element. The slots 20 are of essentially the same length or slightly greater than the height of the corresponding antennas 14 and 16. At its upper end, antenna 14 is provided with a short extension 30, whereas the lower antenna 16 is provided with an extension 32 extending from its lower end. Extensions 30 and 32 are interconnected with the backscreen 10 by means of mounting brackets 34 and 36, respectively. These brackets are each secured at one end to the backscreen, as with nuts and bolts or with other suitable fastening means such as rivets, welding or soldering, and are each secured at the opposite end to extension 30 or 32, as with nuts and bolts, etc. The brackets 34 and 36 maintain a spacing between the backscreen and the antennas 14 and 16 on the order of one-quarter wavelength ($\lambda$) which distance, at the RF frequencies involved, operates as an open circuit. If the spacing between the backscreen 10 and the panel antenna 12 containing antennas 14 and 16 is decreased, there will be a corresponding increase in the operating frequency of the antenna.

As best seen in FIGS. 3 and 5, the peripheral side edges of the backscreen 10 have been bent to define a peripheral lip 50 that extends perpendicularly from the backscreen in a forward direction toward the antenna 14. This peripheral lip 50 encircles the backscreen as well as the antenna panel 12. The lip 50 extends from the backscreen in the direction of the antenna panel a distance on the order of 0.1 wavelength ($\lambda$) at the operating frequency (F) of the antenna, thereby defining a single shallow cavity behind two interconnected flat dipole antennas 14 and 16. The shallow cavity assists in increasing the azimuthal gain in that it makes the beamwidth somewhat narrower in the horizontal plane. The backscreen reflector forces the radiated energy to go in a forward direction, away from the antenna, as well as to be somewhat narrower and a more focused pattern of energy as compared to an antenna without a reflector.

A radome 54 is illustrated in FIG. 3 and which serves to cover the panel antenna and backscreen. The radome is removed in FIGS. 4 and 5 for purposes of clarity. The radome may be constructed from fiberglass or dielectric insulating material and it serves to protect the antenna system from weather. The radome 54 encircles the peripheral lip 50 and is suitably secured thereto as with nuts and bolts.

A coaxial feed is provided for the antenna system and this feed includes a T-shaped power splitter having an input arm 60 and a pair of output arms 62 and 64. These arms are metal tubular elements and each serves as the outer conductor of a coaxial feed. Inner conductors 66, 68 and 70 are centrally located within arms 60, 62 and 64, respectively. The inner conductors 66, 68 and 70 may take the form of tubular members and each serves as the inner conductor of a coaxial feed. The inner conductors 66, 68 and 70 are suitably connected together to form a T-shaped member inside the outer coaxial tubular members 60, 62 and 64.

Arm 60 extends through a rectangular plate 72 which is soldered to the arm and extends outwardly therefrom. The plate 72 is suitably secured, as by nuts and bolts, to the backscreen 10. An RF feed from an RF source 80 includes a semi-flexible coaxial cable having an outer conductor 82 and an inner conductor 84. In assembly, the outer conductor 82 is suitably connected to the outer conductor arm 60 whereas the inner conductor 84 is suitably connected to the inner conductor 66 of the power splitter.

The power splitter has a single coaxial input which includes the inner conductor 66 and the outer conductor 60. It also has a pair of coaxial outputs including the upper arm 62 which serves as an outer coaxial conductor and the inner conductor 68. Another coaxial output includes the lower arm 64 which saves as a coaxial outer conductor together with the inner conductor 70.

Each of the antennas 14 and 16 is provided with a pair of feed points 90 and 92 which are located on opposite sides of the slot 20 and intermediate the ends of the slot. These two feed points 90 and 92 for each antenna are connected to the coaxial feed system. The outer conductor is connected to feed point 90 and the inner conductor is connected to feed point 92. Specifically, the top of the outer conductor 62 is connected to the feed point 90 by means of a conductive saddle member 94. The saddle member 94 is electrically and mechanically connected to the feed point 90, as with a nut and bolt. Similarly, the upper end of the inner conductor 68 is electrically connected to the feed point 92 by means of a center conductor feed strap 96. Strap 96 is electrically connected to the inner conductor, but insulated from the outer conductor. The strap 96 extends across the slot 20 and is mechanically and electrically connected to the feed point 92, as with a pair of nuts and bolts. The bottom of the inner conductor is electrically and mechanically connected to the feed point 92 of the lower antenna 16 in the manner as discussed hereinabove with a feed strap 96. Also, the outer conductor or lower arm 64 is electrically and mechanically connected at its lower end to the feed point 90 with a saddle member 94.

From the foregoing, it is seen that the T-shaped power splitter serves as a coaxial feed having a single coaxial input having inner and outer conductors and a pair of coaxial outputs having inner and outer conductors. The inner and outer conductors of each of the coaxial outputs are connected across a respective one of the feed points of one of the antennas 14 and 16 so as to feed each pair of feed points with electromagnetic energy 180 out of phase.

The upper and lower arms 62 and 64 are mechanically and electrically connected to the intermediate member 18 by means of electrically conductive saddles 102 and 104. The saddles 102 and 104 may be connected to the intermediate member 18 at connection points 106 and 108, respectively, as with suitable nuts and bolts. The saddles 102 and 104 may be connected to conductor arms 62 and 64 by means of suitable electric straps 110 and 112 respectively.

Referring again to FIGS. 1 and 2 the lower portion of the mast 8 carries antenna group 3. Within the mast, there is provided a cylindrical coaxial feed 6 which extends upward for feeding the antenna bays in the antenna group 4.

Figure 6:
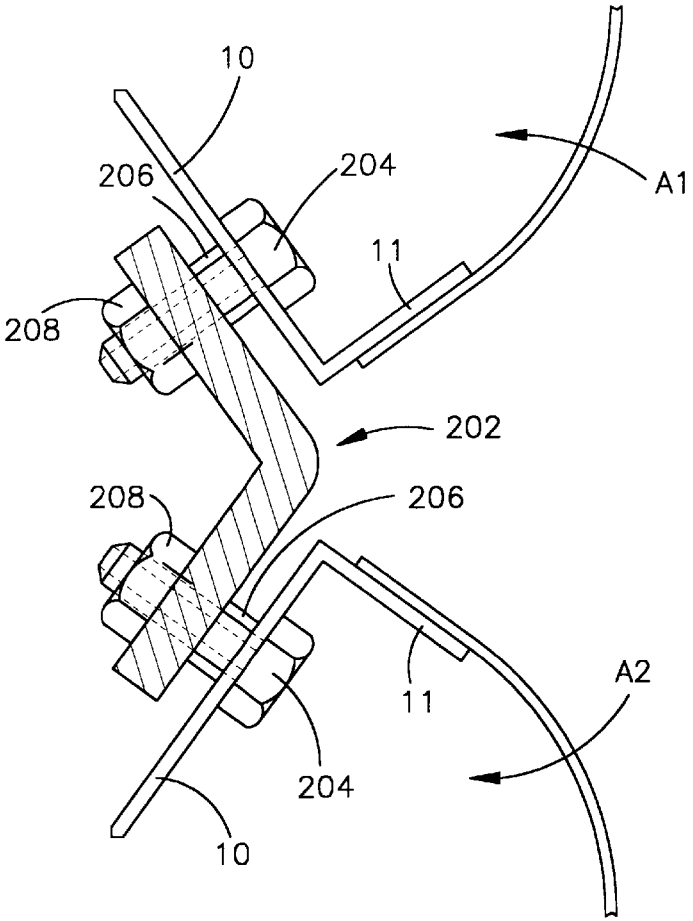
Fig.6 PRIOR ART
FIG. 6 is an enlarged sectional view of a corner in FIG. 2.

Reference is now made to FIGS. 2 and 6 from which it is seen that adjacent panel antennas are interconnected by means of metal supports 200, 202, 203, 204 and 205. Each of these supports is constructed as described in conjunction with support 202 illustrated in FIG. 6. This support interconnects adjacent panel antennas A1 and A2. The support 202 extends vertically and is coextensive with the two antenna groups 3 and 4. Only a single bay is described in detail herein. The backscreen 10 of panel antenna Al is mounted to the support 202 as with suitable bolts 204 (only one being shown in FIG. 6), each of which extends through a suitable aperture in the backscreen 10 of panel antenna A1 and, thence, through a spacer 206 and through a suitable aperture in one leg of support 202 and, thence, through a nut 208. The backscreen 10 of panel antenna A2 is secured to a second leg of support 202 in the same manner as described above for panel antenna A1.

The prior art mast illustrated in FIG. 2 is pentagonal with each face having a width on the order of 20 inches. Consequently, the backscreen for each panel antenna also has a width on the order of 20 inches.

Figure 11:
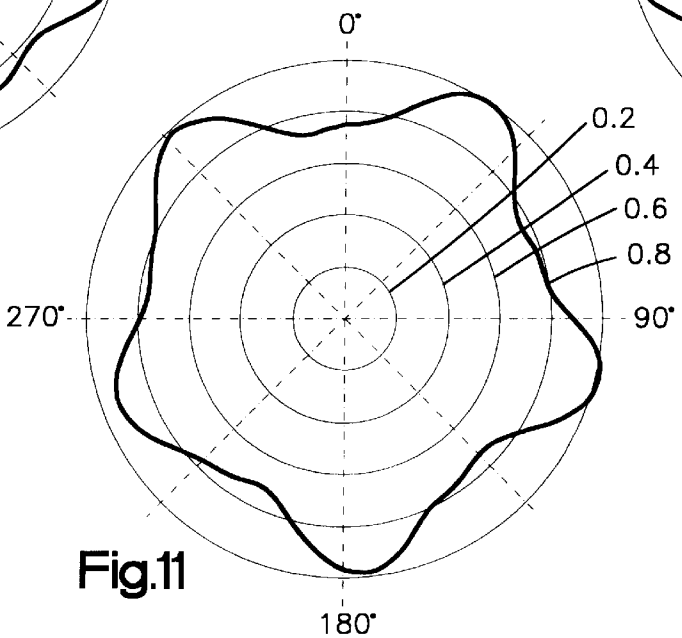
FIG. 11 illustrates a horizontal polarized Azimuthal radiation pattern for a structure as shown in FIG. 2.
Figure 10:
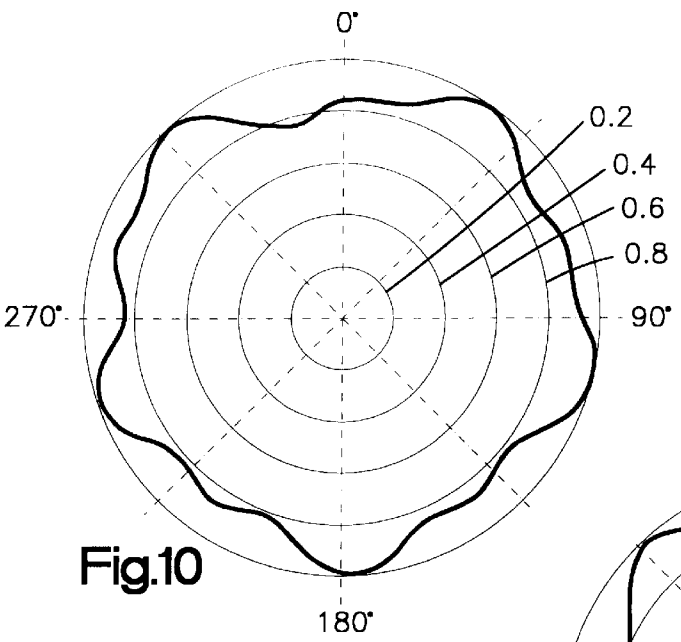
FIG. 10 illustrates a horizontal polarized Azimuthal radiation pattern for a structure as shown in FIG. 2.

Reference is now made to FIGS. 10 and 11 which illustrate azimuth patterns which have been measured for a single bay having five panel antennas around a pentagonal mast, as in the example of FIG. 2. The azimuth pattern of FIG. 10 is taken from a single bay as shown in FIG. 2 at an operating frequency of 509 MHz. A pattern at a frequency of 569 MHz is shown in FIG. 11. Two problems are noted with respect to these two patterns. The pattern circularity is not ideal because each pattern exhibits nulls which extend well under 80% relative field and at times the nulls approach approximately 70% relative field (particularly note the pattern in FIG. 11). Additionally, a mast constructed as shown in FIG. 2 presents a relatively small mast structural cross section having panel faces which are on the order of 20 inches wide and this limits the number of bays that may be stacked on top (due to this small structural cross section).

Figure 7:
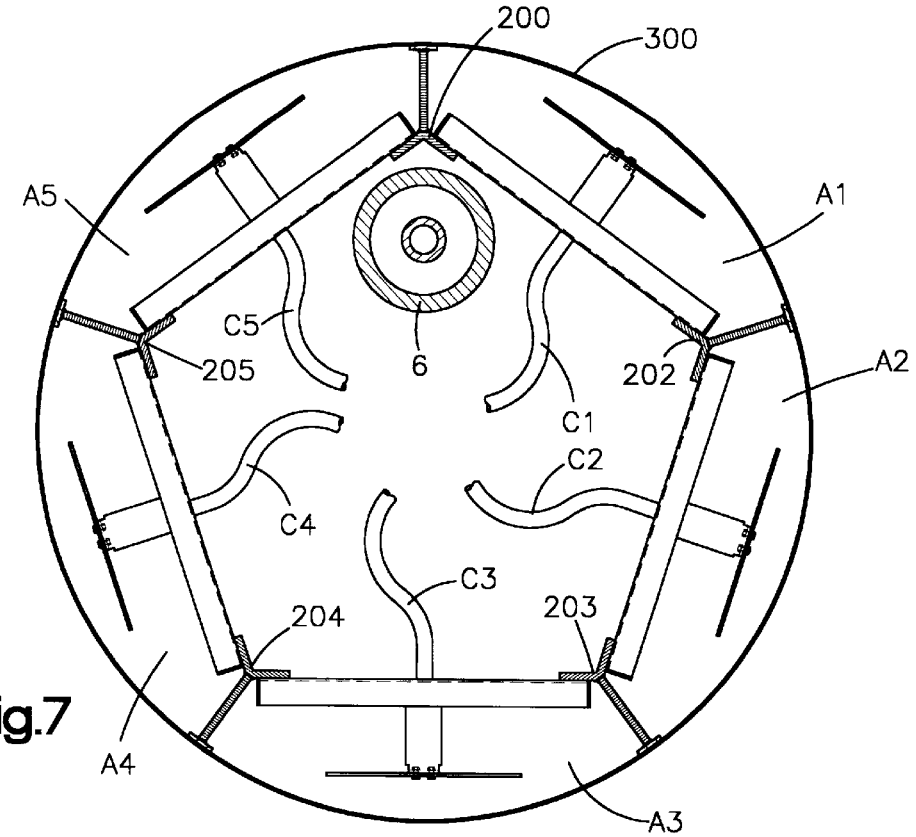
FIG. 7 is a view similar to that of FIG. 2 but illustrating the construction in accordance with the present invention.

Reference is now made to the embodiment of the invention as illustrated in FIG. 7. This embodiment is similar to that of the prior art shown in FIG. 2 but with some notable exceptions. To simplify the description like components in FIGS. 2 and 7 are identified with like character references. The embodiment of FIG. 7 includes a pentagonal mast having five panel antennas A1, A2, A3, A4 and A5 mounted on the mast. These panel antennas may be identical to those shown in FIG. 2 but with the radome removed from each panel antenna. This embodiment employs a single cylindrical shaped radome 300 which encircles the mast for the entire length thereof corresponding with antenna groups 3 and 4. This radome corresponds with the radome 2 illustrated in FIG. 1. The mast of FIG. 7 also includes the supports 200, 202, 203, 204 and 205 each of which interconnects a pair of adjacent panel antennas and also extends vertically and is coextensive with the two antenna groups 3 and 4.

Figure 8:
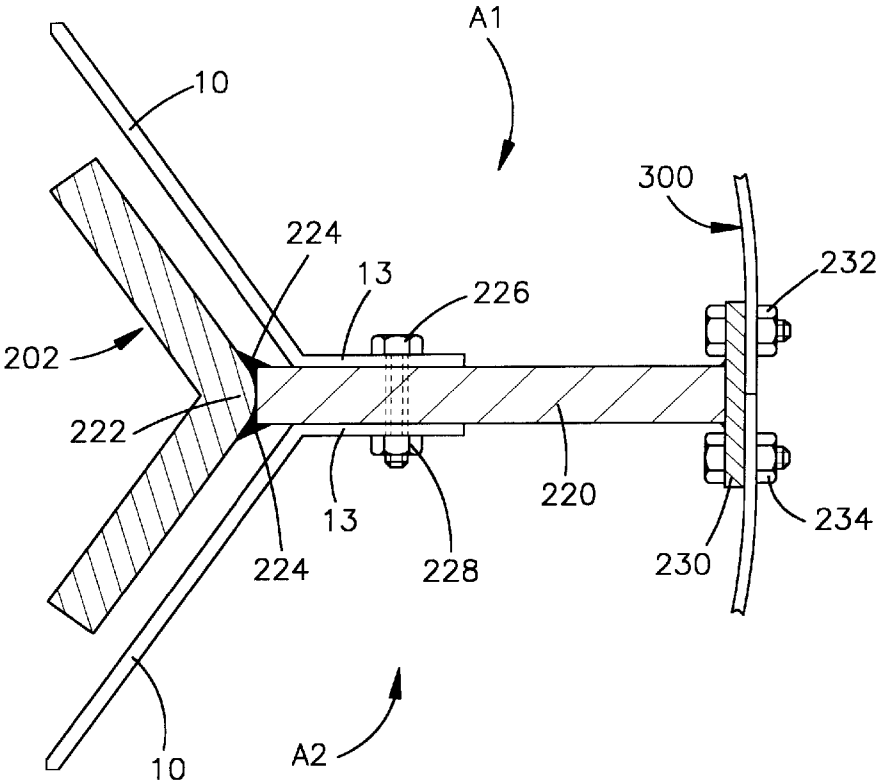
FIG. 8 is an enlarged sectional view of a corner in FIG. 7.

Each of the supports and associated elements are constructed in the manner as illustrated in FIG. 8 with reference to support 202. The backscreen 10 of each antenna A1 and A2 in FIG. 6 has a portion which is bent back to provide a flange 11 to which a portion of panel radome is suitable secured. The backscreens 10 in antennas A1 and A2 in FIG. 8 also include flanges 13 which have been bent (but not to the extent as flanges 11 in FIG. 6). Fin 220 extends radially outward from the apex 222 of the support 202 and also extends vertically and is coextensive with the support 202 and is secured thereto as with a suitable weld 224. Flanges 13 extending from backscreens 10 of adjacent panel antennas A1 and A2 are spaced apart sufficient to receive a portion of the length of fin 220 and are secured to the fin by means of a suitable fastening means taking the form of a bolt 226 and a nut 228 assembly, as shown. The fin 220 extends radially outward toward the radome 300. The distal end of the fin carries a mounting plate 230 which is fastened to the fin 220 as by welding. The mounting plate 230, in turn, is secured to the radome 300 as with suitable nut and bolt assembles 232 and 234. The fin 220, as in the case of support 202, is constructed of electrically conductive material such as steel, copper or aluminum. The fin 220 may have a length on the order of 5 inches and a thickness on the order of ¼ inch to 1 inch.

The addition of the radially extending fins 220 serves to increase the structural strength of the mast to thereby increase its ability to permit stacking of antenna bays on top of each other. The addition of the fins adds mass to the structure which is spaced further out from the center of the mast resulting in an increase in the structural cross section and, hence, in structural strength for stacking of antenna bays.

In addition to increasing the structural strength, these radially extending fins result in an improvement to the pattern circularity.

Figure 12:
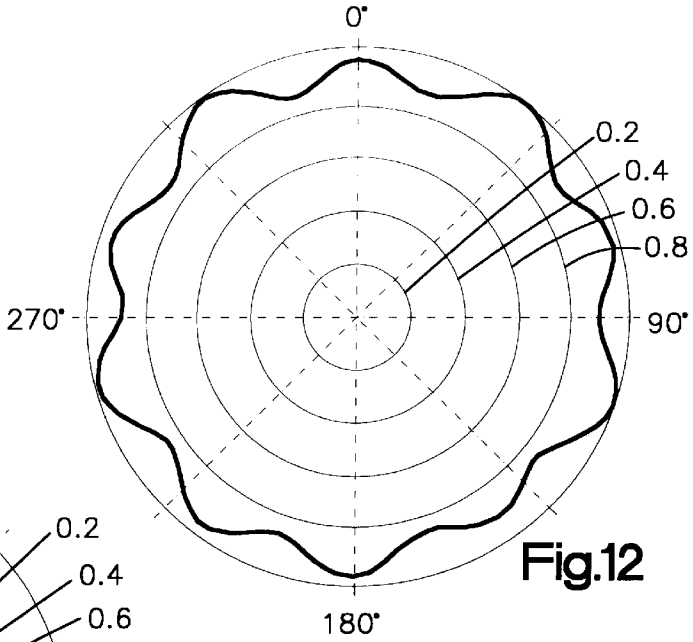
FIG. 12 illustrates a horizontal polarized Azimuthal radiation pattern for a structure as shown in FIG. 7.

Reference is now made to the azimuth patterns in FIGS. 12 and 13. Each of these patterns is for a mast arrangement such as that shown in FIG. 7 with five panel antennas mounted around the mast with each face having a width on the order of 20 inches. The pattern in FIG. 12 is for a frequency of 509 MHz and that for FIG. 13 is for a frequency of 569 MHz. It is to be particularly noted when comparing FIG. 12 with FIG. 10 that the circularity has increased with the nulls in FIG. 12 being greater than 80% relative field. Also, when comparing FIG. 13 with FIG. 11 note that the pattern in FIG. 13 has greater circularity and the nulls are all in excess of 80% relative field.

It has been found that by increasing the thickness of the fins 220 from approximately ¼ inch to 1 inch that the structural strength is further increased for supporting antenna bays. The additional strength has been achieved while obtaining essentially the same pattern circularity. The azimuth patterns of FIGS. 14 and 15 are for fins of 1 inch thickness at frequencies of 509 MHz and 569 MHz, respectively.

Figure 9:
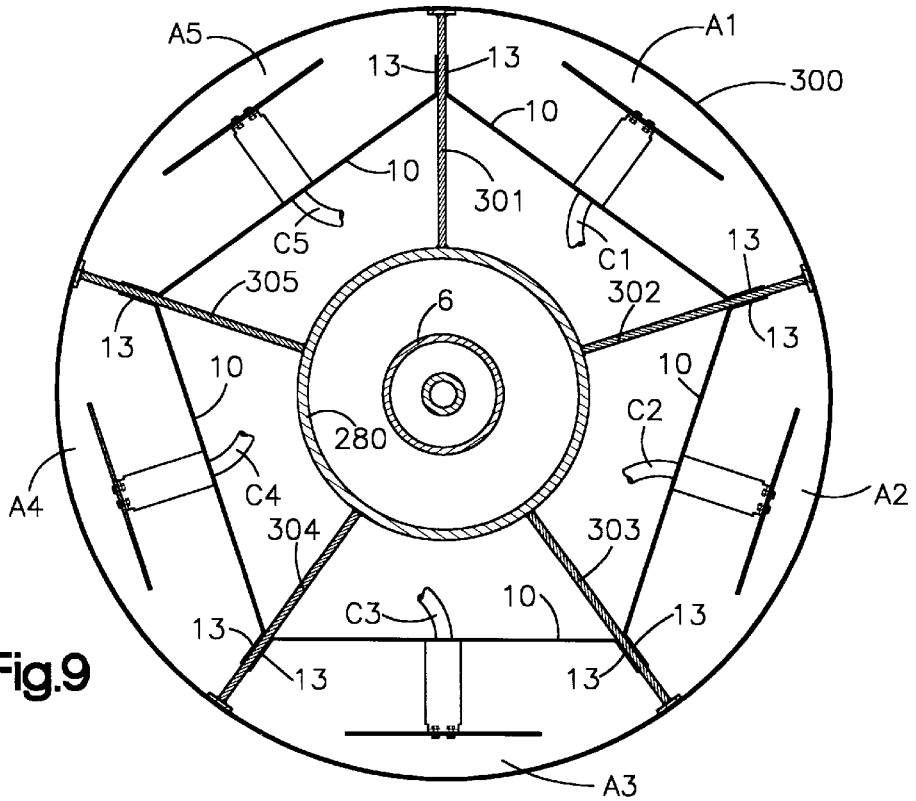
FIG. 9 is a view similar to that of FIG. 7 but illustrating an alternative embodiment of the invention.

Reference is now made to FIG. 9 which represents another embodiment of the present invention. This embodiment is similar to that as shown in FIG. 7 and consequently like components are identified with like character references. This embodiment includes panel antennas A1, A2, A3, A4 and A5 mounted around a pentagonal mast.

In this embodiment, a cylindrical tube 280 is located at the center of the mast and extends axially therethrough and serves to carry the coaxial feed 6 to the upper group of antenna bays (see FIG. 1).

The radially extending elongated fins 301, 302, 303, 304 and 305 extend radially outward from tube 280 and, thence, through a respective one of the five corners defined by the adjacent panel antennas. The proximal ends of the fins are suitably secured to the tube 280, as by welding, and the distal ends extend radially outward to and are secured to the encircling radome 300 in a manner described hereinabove with reference to FIG. 8.

As in the embodiment described in FIG. 8 each of the backscreens 10 of the panel antennas has a flange 13 which extends somewhat radially outward from one of the corners of the antenna mast. Adjacent flanges 13 provide a space for receiving a portion of the radially extending section of one of the fins 301–305. Each of the fins is secured to a pair of flanges 13 of adjacent panel antennas as with suitable nut and bolt arrangements as is illustrated in FIG. 8.

Although the invention has been described in conjunction with preferred embodiments, it is to be appreciated that various modifications may be made without departing from the spirit and scope of the invention as defined by the appended claims.

Having described the invention, it is now claimed:

1. An antenna system for use in radiating RF energy and comprising:

a vertical mast having N vertically oriented faces surrounding a vertically extending axis, and wherein N is at least 3;

a plurality of vertically spaced antenna bays, each bay having an array of N antennas carried by said mast, with each antenna including radiating means located substantially in a plane parallel to one of said N faces, each said face being oriented at a given angle of $$\frac{360°}{N}$$

from an adjacent said face;

said mast having N corners, each said corner being located intermediate a pair of adjacent said faces; and, N fins, each associated with one of said corners, each said fin extending radially outward of said axis beyond the associated said corner.

2. An antenna system as set forth in claim 1 wherein each said face has a radially extending flange and means for securing said flange to one of said fins.

3. An antenna system as set forth in claim 2 wherein the radially extending flanges of adjacent faces extend radially outward of said mast and are spaced from each other on opposite sides of a said radially extending fin.

4. An antenna system as set forth in claim 3 wherein each said fin has a distal end, a cylindrical radome coaxially encircles said mast, and means for securing the distal end of each said fin to said radome.

5. An antenna system as set forth in claim 4 wherein said means for said securing includes a mounting plate secured to the distal end of each said fin and means for fastening said mounting plate to said radome.

6. An antenna system as set forth in claim 3 wherein each said fin has an proximal end spaced radially inward toward said axis away from said distal end and extending inwardly of a said corner.

7. An antenna system as set forth in claim 6 including vertically extending support means located within said mast, said support means being secured to the proximal ends of said fins.

8. An antenna system as set forth in claim 7 wherein said support means includes a vertically extending centrally located hollow tube which surrounds said axis.

9. An antenna system as set forth in claim 8 wherein said tube is a cylindrical tube which coaxially surrounds said axis.

10. An antenna system as set forth in claim 7 wherein said support means includes N vertically extending corner support members each located within said mast at one of the corners therein, each said support member being secured to a selected one of said N fins.

11. An antenna system as set forth in claim 10 wherein each said corner support member is V shaped in cross section.

12. A television antenna bay composing:

at least three panel antennas, each including radiating elements secured to a back reflector arranged about an antenna bay axis to provide an omnidirectional radiation pattern for television signals;

a signal feed arrangement coupled to the panel antennas for applying television signals thereto;

a plurality of a combined support member and fin arrangements, each of the support members extending vertically within the antenna bay and coextensive therewith with the fins extending radially outward from the antenna bay between separate panel antennas, and means for securing the back reflectors of the panel antenna to the support member and fin arrangements provide support for the panel antennas within the antenna bay.

13. A television antenna bay as set forth in claim 12 wherein:

the signal feed arrangement includes a rigid tube extending within the antenna bay that carries the signal coaxial cables within the tube, and the support member and fin arrangements extend inwardly within the antenna bay and attach to the rigid tube.

14. A television antenna bay as set forth in claim 12 wherein:

the thickness of the fins and the extent to which the fins extend beyond the panel antenna is selected to enhance the omnidirectional pattern circularity.

15. A television antenna bay as set forth in claim 12 wherein:

the back reflectors have a generally rectangular shape with the ends thereof bent outwardly to form a shallow cavity for the reflective element, and the securing means secures the bent edges to the fins.

16. A television antenna bay as sot forth in claim 15 including:

a radome surrounding all of the antenna panels, and the end of each fin extending from the support means is secured to the radome.

17. A television antenna section comprising:

a plurality of vertically stacked antenna bays;

at least three panel antennas included in each bay, each panel antenna including a radiating element secured to a back reflector and arranged about the vertical antenna bay axis to provide an omnidirectional radiation pattern for television signals;

a signal feed arrangement coupled to each of the panel antennas in each antenna bay for applying separate television signals to each antenna bay;

a plurality of a combined support member and fin arrangements, each of the support members extending vertically within the antenna bays and coextensive with the antenna section with the fins extending radially outward from the antenna bay between separate panel antennas, and means for securing the back reflectors of the panel antennas to the support member and fin arrangements provide support for the panel antennas within the antenna section.

18. A television antenna section as set forth in claim 17 wherein:

the signal feed arrangement includes a rigid tube arrangement extending within the antenna bays and coextensive with the antenna section that carries the signal coaxial cables within the tube arrangement, and the support member and fin arrangements extend inwardly within the antenna bays and attach to the rigid tube.

19. A television antenna section as set forth in claim 17 wherein:

the thickness of the fins and the extent to which the fins extend beyond the panel antenna is selected to enhance the omnidirectional pattern circularity.

20. A television antenna section as set forth in claim 19 wherein:

the back reflectors have a generally rectangular shape with the ends thereof bent outwardly to form a shallow cavity for the reflective element, and the securing means secures the bent edges to the fins.

21. A television antenna section as set form in claim 20:

including a radome surrounding all of the antenna panels, and wherein the ends of the fins extending from the support means are secured to the radome.

22. A television antenna section as set forth in claim 17 wherein:

the antenna section is adapted to be connected to another antenna section to provide a multiple section vertical antenna structure whereby the support members in both antenna sections provide support for the combined multiple section antenna structure.

23. In a television antenna bay including at least three panel antennas, each including radiating elements secured to a back reflector and arranged about an antenna bay axis to provide an omnidirectional radiation pattern for television signals, a signal feed arrangement coupled to the panel antennas for applying television signals thereto, a plurality of support members with each of the support members extending vertically within the antenna bay and coextensive therewith, a method of providing added support for the antenna bay as well as improving the omnidirectional pattern circularity comprising the steps of:

connecting a fin to each of the support members so as to extend outward from the antenna bay between separate panel antennas so as to provide a combined support member and fin arrangement to provide added structural strength for supporting the panel antennas in the antenna bay, securing the back reflectors of the panel antenna to the combined support member and fin arrangement, and selecting the thickness of the fins and the extent to which the fins extend from the support member so as to improve the omnidirectional pattern circularity on the antenna bay.

24. A method as defined in claim 23 including:

providing a rigid tube within the antenna bay and coextensive with the antenna bay to carry coaxial signal cables within the tube for the signal feed arrangement, extending the support member and fin arrangements inwardly within the antenna bay, and attaching the support and fin arrangement to the rigid tube.

25. In a television antenna section including a plurality of vertically stacked antenna bays, at least three panel antennas included in each bay, each panel antenna including a radiating element secured to a back reflector and arranged about the vertical antenna bay axis to provide an omnidirectional radiation pattern for television signals, a signal feed arrangement coupled to each of the panel antennas in each antenna bay for applying separate television signals to each antenna bay, a plurality of support members extending vertically within the antenna bays and coextensive with the antenna section a method of providing added support for the antenna bays within the antenna section as well as improving the omnidirectional pattern circularity comprising the steps of:

connecting a fin to each of the support members so as to extend outward between separate panel antennas so as to provide a combined support member and fin arrangement to provide added structural strength to the support the panel antennas in the antenna section:

securing the back reflectors of the panel antennas to the combined support member and fin arrangement to provide support for the panel antennas within the antenna section and, selecting the thickness of the fins and the extent to which the fins extend from the support member so as to improve the omnidirectional pattern circularity on the antenna bay.

26. A method as defined in claim 25 including:

providing a rigid tube arrangement extending within the antenna bays and coextensive with the antenna section to carry coaxial signal cables within the tube for the signal feed arrangement, extending the support member and fin arrangements inwardly within the antenna bay, and attaching the support and fin arrangement to the rigid tube.

* * * * *